United States Patent [19]

Gerritsen

[11] Patent Number: 4,658,548

[45] Date of Patent: Apr. 21, 1987

[54] WEATHERSTRIP MEMBER WITH FLOATING INTERIOR BULB

[75] Inventor: John T. Gerritsen, Hanover Park, Ill.

[73] Assignee: Jarrow Products Inc., Chicago, Ill.

[21] Appl. No.: 630,087

[22] Filed: Jul. 12, 1984

[51] Int. Cl.[4] ..... E06B 7/16

[52] U.S. Cl. ..... 49/498; 49/489; 49/497

[58] Field of Search ..... 49/489, 498, 497, 485

[56] References Cited

U.S. PATENT DOCUMENTS

| | | | |
|---|---|---|---|
| 2,622,286 | 12/1952 | Beck | 49/497 |
| 2,908,949 | 10/1959 | Frehse | 49/497 |
| 2,935,771 | 5/1960 | Hatcher, Jr. | 49/498 |
| 3,238,573 | 3/1966 | Pease, Jr. | 49/489 |
| 3,656,260 | 4/1972 | Weaver et al. | 49/489 |
| 3,690,037 | 9/1972 | Kempel | 49/489 |
| 3,952,455 | 4/1976 | McAlarney | 49/497 |
| 4,006,562 | 2/1977 | Belanger et al. | 49/489 |

FOREIGN PATENT DOCUMENTS

| | | | |
|---|---|---|---|
| 711051 | 6/1965 | Canada | 49/498 |
| 2401465 | 7/1975 | Fed. Rep. of Germany | 49/485 |

*Primary Examiner*—Kenneth J. Dorner
*Assistant Examiner*—Mark W. Binder
*Attorney, Agent, or Firm*—Silverman, Cass, Singer & Winburn, Ltd.

[57] ABSTRACT

A unitary extruded weatherstrip for doors and the like including a flexible loop having a floating bulb therewithin connected to the wall of the loop and functioning as a secondary seal. The floating bulb under compression, prevents collapse of the loop inward or outward to provide an effective seal. The failure of the weaterstrip outwardly to collapse prevents its protrusion past the face of the door whereby to retain the aesthetic appearance of the installation. The same weatherstrip configuration can be employed on both the hinge and the lockside portions of the frame as well as along the header thereof. A rigid depending portion flange can be provided as a part of the weatherstrip extrusion to permit installation into the saw-kerf of wood door frames, for example, without requiring special tools.

11 Claims, 5 Drawing Figures

WEATHERSTRIP MEMBER WITH FLOATING INTERIOR BULB

BACKGROUND OF THE INVENTION

This invention relates generally to weatherstrip sealing members for doors or the like, and more particularly, provides a unitary weatherstrip having a rigid base and a hollow flexible loop including a floating bulb interior of the loop serving as a secondary seal, hinged to prevent collapse under compression and having unusual versatility.

Many arrangements have been employed for providing seals of varying effectiveness about the edges of doors to prevent or limit the flow of air therepast and thereby to reduce heating or cooling loss, as well as to eliminate drafts, prevent the passage of rain, snow or other wind-driven material into the building.

In addition to effecting an airtight seal between the door and the frame therefor, it is desirable to provide means which cushion the door upon closing, facilitate quick release when opening the sealed door, reduce abrasion, provide for resilience upon compression to prevent deformation or collapse of the sealing strip inward or outward, permit use of the same structure on the header, the hinge and the locking jamb, have long life, retain sealing ability, provide easy fabrication installation and versatility for use on both metal and wood door frames capable of long use before requiring replacement, which is resistant to distortion and effects its sealing function independent of surface irregularities.

SUMMARY OF THE INVENTION

The invention provides an extrudible weatherstrip sealing system for doors and the like comprising a unitary sealing strip having a rigid base and a flexible wall defining a primary loop along one surface of the base and a free floating hollow bulb interior of the primary loop connected to the primary loop at one location, the floating bulb functioning as a secondary seal and being translatable under compression along a path generally parallel to the base whereby to inhibit collapse of the primary loop.

DESCRIPTION OF PREFERRED EMBODIMENT

The weatherstrip embodying the features of the invention shall be described as comprising an elongate rigid, unitary extrudate as a generally planar base having a flexible wall joined along opposite edges of the base to define a primary hollow loop. A portion of the flexible wall is joined to a floating hollow bulb interior of the primary loop. The floating hollow bulb functions as a secondary seal and is hingedly connected to the base by way of a portion of the flexible wall, the bulb being capable of movement under compression in a path generally parallel to the base toward the center of the primary loop so as to prevent collapse of the primary loop and form a sealing engagement with the door frame. As will be described, the base is provided with depending barb flange means for securement in a saw-kerf conventionally formed in door frames.

Figure 1:
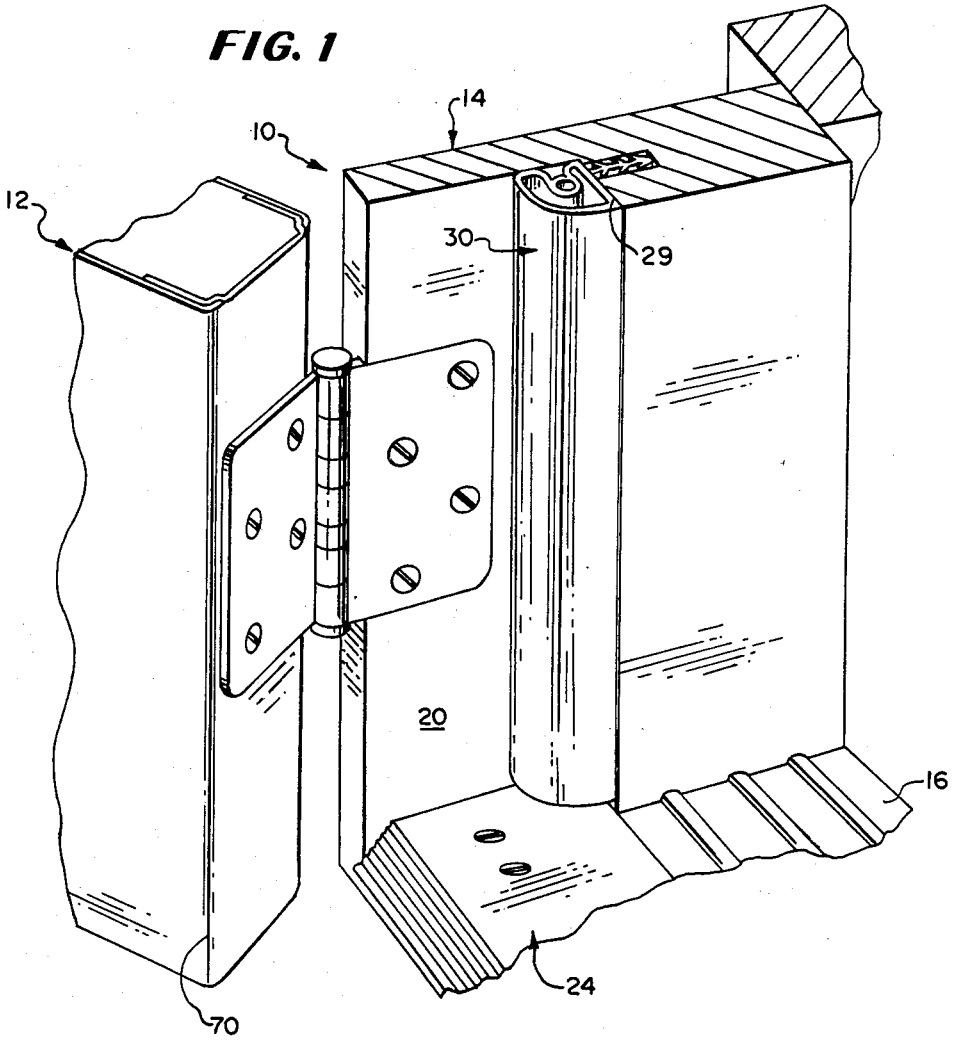
FIG. 1 is a front elevational fragmentary view of a swinging door installation viewed from the exterior and including the weatherstrip sealing member according to the invention installed thereon.

Referring now to FIG. 1, there is illustrated a door and frame assembly 10, including a door 12, a wooden frame 14 precut and sized to fit about the door 12 with a known amount of side clearance, a threshold 16 for disposition below the door 12, a pair of sides 18,20 one functioning as lock jamb and the other functioning as a hinge jamb, and a header 22 serving as the overhead connection between the upper ends of the sides 18 and 20. The weatherstrip sealing member 30 embodying the invention is installed along the frame 14. A door bottom sweep 24 is installed along the threshold 16.

A shoulder stop 26 is formed on the header 22 and like shoulder stops 28,29 are formed on the lock and hinge jambs 18,20 respectively, thereby providing stops for the door 12 within the frame 14. The saw-kerfs 32,33 and 34 are provided at the base of each of the stop shoulders 26, 28, 29 respectively to enable the weatherstrip member to be secured therein.

The weatherstrip sealing member 30 is formed as a unitary extrusion of plastic material such as polyvinyl chloride, low density ethylene, thermoplastic rubber, neoprene, polypropylene, thermoplastic elastomers, ethylene vinyl acetate, silicone rubber, etc. Plasticizers are added for obtaining specific durometer materials. Preferably, a single pass through the conventional extruder apparatus is required, the extrudate being a single or a dual durometer extrusion.

The base 36 of the strip 30 rests on the appropriate one of shoulder stops 26, 28, 29 with the relatively rigid depending barbed leg 38 seated in the respective saw-kerf 32, 33 or 34. The leg 38 is in the form of a depending arrow with head 40 having oppositely directed resilient tips 42 preferably of the more flexible material. Additional tips or barbs 44 likewise are flexible in contrast to the leg 38 and head 40 per se. The resilient tips are formed of more plasticized material and can be deformed to facilitate entry into and retention within the appropriate one of saw-kerfs 32,33 and 34.

The primary or outer loop 46 is defined by flexible wall 48 joined to the base 36 extending coextensively along the opposite edges 50,52 of said base 36. Interior loop or bulb 54 is joined to wall 48 at location 56 with the portion 58 of wall 48 functioning as a hinge wall connection between the base 36 and the bulb 54. Bulb 54 and loop 46 share a common wall portion 56'. Bulb 54 is hollow along its length and floats freely within the loop 46. The base 36 is formed of more rigid material than the material used to form the loops 46 and 54. The base 36 may be generally planar in configuration although a broadened V cross-section is feasible such as indicated in phantom line 36' illustrating its functioning as a supplementary aid in sealing. As mentioned above, the weatherstrip sealing member 30 is extruded employing conventional dual durometer extruders. The opposite ends of the loops optionally may be open or closed depending upon the installation.

Figure 2:
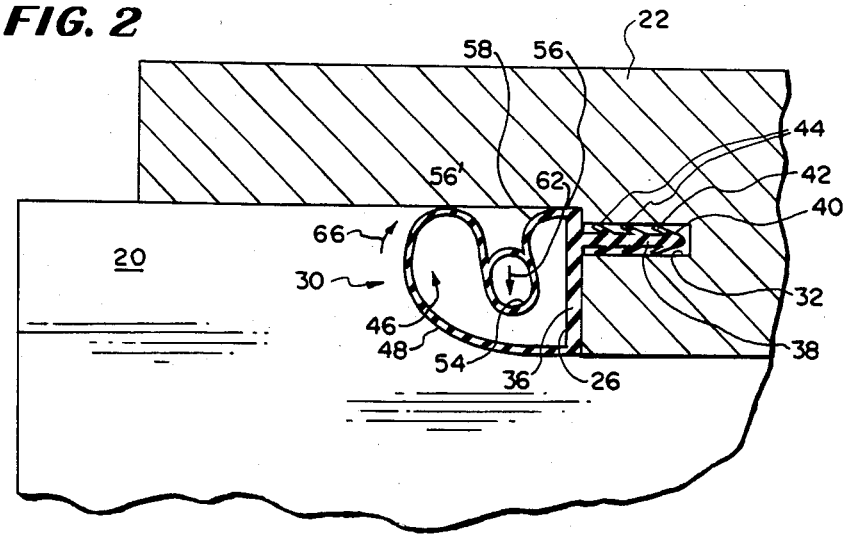
FIG. 2 is an enlarged cross-sectional view along lines 2—2 of FIG. 1 and in the indicated direction.
Figure 4:
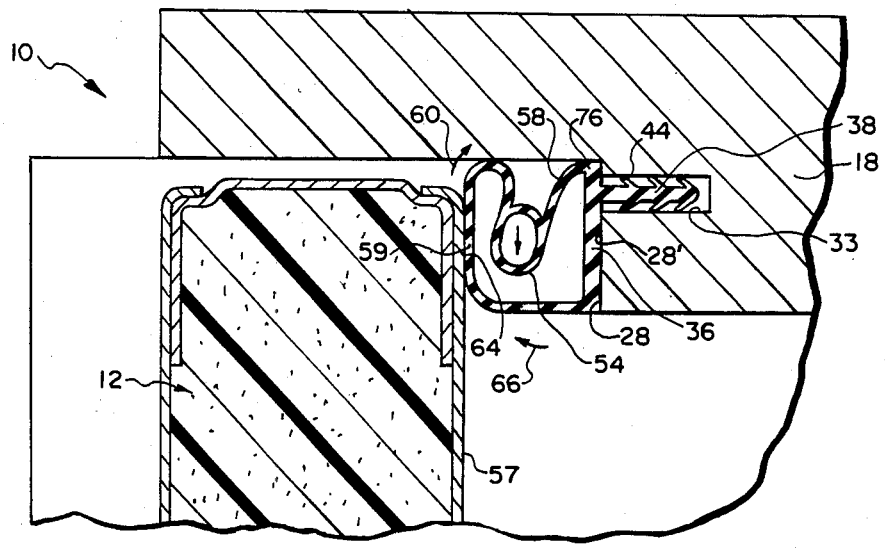
FIG. 4 is an enlarged cross-sectional view similar to FIG. 3 of the weatherstrip sealing member according to the invention but showing installation on the lockjamb of the door frame, and, FIG. 5 is an enlarged, cross-sectional view of the weatherstrip sealing member according to the invention.
Figure 3:
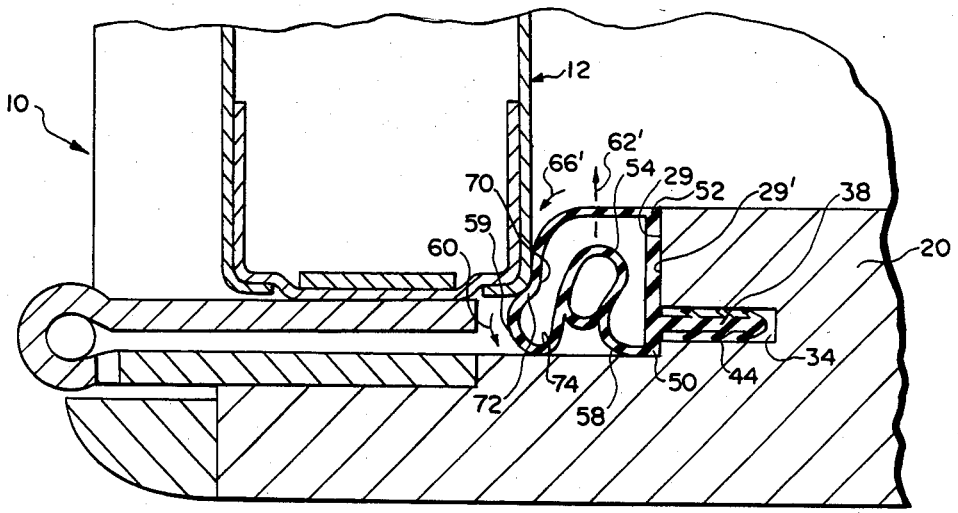
FIG. 3 is an enlarged cross-sectional view similar to that of FIG. 2 but illustrating installation on the hinge jamb of the door frame.
Figure 5:
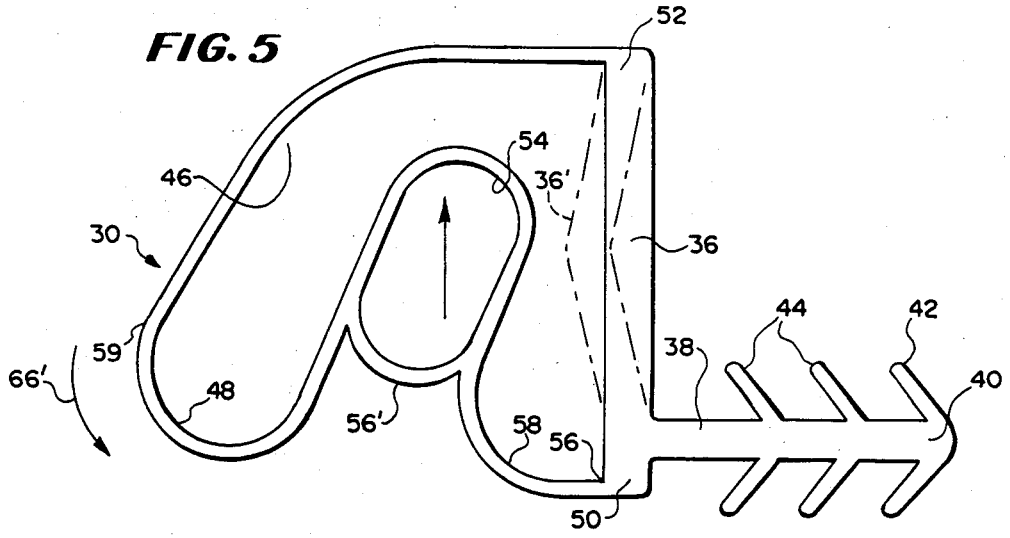

Referring to the FIGS. 2 and 4, the weatherstrip sealing member 30 is illustrated as installed on either the header 22 or on the lock jamb 18, while in FIG. 3 the installation illustrated is secured on the hinge jamb 20 of door frame 14. In all examples, the barbed leg 38 is seated forcibly into the appropriate precut saw-kerf 32, 33 or 34. The base 36 rests on the shoulder. The base 36, though relatively rigid, retains some operational resilience, particularly when in the wide-angle broadened V formation.

As shown in FIG. 4, when the surface 57 of the door 12 engages the outermost portion 59 of the primary loop 46, the loop 46 is caused forcibly to move in a clockwise direction indicated by arrow 60. As said loop 46 travels along the clockwise path, hollow bulb 54 is caused to move along a path indicated by arrow 62, in a direction generally parallel to the shoulder, that is parallel to the general plane in which the base 36 is disposed. The bulb 54 is forced to move to a position intermediate the door and jamb surfaces 57 and 28' respectively to a disposition located approximately at the midpoint taken across the base 36.

The location of the bulb 54 under the resulting compression, prevents the collapse of loop 46 and/or bulb 54. Thus, the deformation of the loops is insufficient to result in overhang of the weatherstrip sealing member 30 or protrusion thereof past the face of the door 12. Hence the aesthetic appearance of the resulting closure will not be marred. Further, the weatherstrip 30 will not be stressed unduly at select areas thereof, such type of localized stress in prior art constructions ordinarily resulting in fracture and/or under and rapid aging leading permanent deformation. The loops are not flattened and will not be susceptible to flattening whereby to preserve their resilience and enable quick recovery of the weatherstrip 30 upon opening of the door 12. Crimping of the tubular or looped portions is not likely to occur hence one can expect extended useful life expectancy of the weatherstrip sealing member.

The wall portion 58 serves as a flexible hinge to pivot the floating bulb as well as to guide its movement in the aforementioned generally horizontal plane. The structure contemplated by the invention enables the omission of conventional magnetic means conventionally employed for establishing an effective seal. The airtight seal between the door and door jambs actually attained is effected solely by mechanical action. Further, no conventional bellows is required.

The weatherstrip sealing member 30 of the invention is unusually versatile, its use not being limited to any particular material, i.e. can be employed, without change of material or configuration, to doors formed of wood, doors formed of ferrous materials or doors formed of nonferrous metal materials. The base is not required to be positively fastened to the door frame by nails, screws, etc.

The installation and operation of the weatherstripping sealing member 30 on the hinge jamb 20 can be understood easily by viewing FIG. 3. As shown in FIG. 3, the corner 70 of door 12 engages location 72 on the primary loop 46 forcing a partial loop 74 to be formed and causing said loop 74 sealingly to engage the side 20 effecting a seal with said side as well as establishing a primary sealing engagement between the corner 72 of door 12 and the loop 46. The bulb 54 tethered on portion 58 of the wall 48 is directed in a generally horizontal path outward of hinge jamb 20, the path being generally parallel to the base 36. The movement of bulb 54 is continued until the bulb reaches a disposition approximately at a location axially superimposed above the midpoint of the base 36 between the pair of edges 50,52 thereof. The loop 46 is directed in a counter-clockwise path indicated by arrow 66'. The path of travel of the bulb 54 is indicated by arrow 62'. Under compression, the pivot point of hinge portion 58 is indicated by reference character 76.

Thus there is a dual airtight seal formed under compression. The partial loop 74 engages the side 20. The corner portion of the loop 46 is engaged by the corner of the door 12 with the resilience of both loop 46 and interior bulb 54 causing a seal to be established at the corner. The dual seal achieved is a considerable improvement over prior single seals often established between the door and a weatherstrip member.

It should be understood that the depending barb formation may be omitted in which case double faced pressure sensitive tape or other fastening means may be employed to secure the base in place on the respective shoulder.

Thus there has been described herein a weatherstrip sealing system for doors or the like whereby the door is cushioned on closing whereby an airtight seal is achieved between the door and the door jamb and the seal easily released when the door is opened, whereby abrasion is reduced, resiliency not compromised, whereby compression set is obviated, whereby the weatherstrip sealing member is easily fabricated and installed, whereby the weatherstrip sealing member has substantial resistance to distortion and whereby the weatherstrip sealing member is capable of long use without requiring replacement. Variations are contemplated in the weatherstrip sealing member structure and materials herein provided without departing from the scope of the invention as claimed hereinafter.

What I claim is:

1. A unitary extruded compressible weatherstrip seal member for a doorframe or the like comprising a longitudinally extending generally planar rigid base member, a continuous distortable flexible wall defining a primary loop member integrally connected to opposite edges of said base and dimensioned to define a continuous internal air space between the interior of said wall and said base and movable along an arcuate path relative to said base during compression, a continuous internal hollow bulb positioned within said primary loop, said bulb defining a secondary loop and including a common outer wall portion with said primary loop, hinge means interconnecting said primary and secondary loop at each end of said common wall portion said secondary loop extending into said air space such that said secondary loop is connected to said primary loop and said base only at said hinge means, and extending throughout the length thereof, said primary loop, said secondary loop, said common outer wall portions thereof, and said hinge means all integrally formed and defining with said base a seal movable between a relaxed condition and a compressed condition, said secondary loop positioned in spaced relation to said base and said flexible wall when said seal is in a relaxed configuration and movable along a path toward said base and generally parallel therewith when said seal wall is distorted by compression to preclude collapse of said flexible wall into direct contact with said base member and resultant reduction in seal efficiency.

2. The weather-strip system as claimed in claim 1 wherein said floating bulb is hingedly coupled to the base by a portion of the wall which defines the primary loop and joins the base at a location proximate to the base.

3. The weatherstrip sealing member as claimed in claim 1 in which the loops are more flexible than the base.

4. The weatherstrip system as claimed in claim 1 in which the primary loop is movable toward the frame along an arcuate path and the secondary loop is movable along a generally horizontal path within the primary loop whereby to define a sealing enagement between the outer loop and the frame under compression in the absence of any protrusion thereof from the frame.

5. The weatherstrip as claimed in claim 1 wherein the secondary loop is positioned between the opposite edges of the base under compression.

6. The weatherstrip system as claimed in claim 1 wherein the primary loop is substantially more flexible than the base.

7. The weatherstrip system as claimed in claim 1 wherein the floating bulb is joined to the primary loop at a location spaced closer to one edge of the base than the other.

8. The weatherstrip system as claimed in claim 1 wherein the axis of the floating bulb is offset from the axis of the primary loop.

9. The weatherstrip system as claimed in claim 1 wherein the floating bulb is joined to the primary loop wall at a location along a portion of the wall defining said primary loop.

10. The weatherstrip system as claimed in claim 1 wherein the floating bulb is joined to the primary loop wall at a location along a portion of the wall defining said primary loop and is hingedly coupled to the base by the wall between said location and said base.

11. The weatherstrip system as claimed in claim 1 wherein the primary loop is movable toward the frame and the floating bulb is movable within said primary loop along a horizontal path relative the base toward a disposition central within the primary loop.

* * * * *